US007217160B2

(12) United States Patent
Hsu

(10) Patent No.: US 7,217,160 B2
(45) Date of Patent: May 15, 2007

(54) ADAPTER FOR HIGH FREQUENCY SIGNAL TRANSMISSION

(75) Inventor: Chin-Teng Hsu, Yungkang (TW)

(73) Assignee: Lih Yeu Seng Industries Co., Ltd., Yungkang (TW)

( * ) Notice: Subject to any disclaimer, the term of this patent is extended or adjusted under 35 U.S.C. 154(b) by 0 days.

(21) Appl. No.: 11/306,834

(22) Filed: Jan. 12, 2006

(65) Prior Publication Data

US 2006/0258225 A1 Nov. 16, 2006

(30) Foreign Application Priority Data

May 10, 2005 (TW) ..... 94207467 U
Nov. 30, 2005 (TW) ..... 94220867 U

(51) Int. Cl.
*H01R 25/00* (2006.01)

(52) U.S. Cl. ..... 439/638; 439/538

(58) Field of Classification Search ..... 439/578, 439/678

See application file for complete search history.

(56) References Cited

U.S. PATENT DOCUMENTS 3,292,117 A * 12/1966 Bryant et al. ..... 333/260
3,437,960 A * 4/1969 Ziegler, Jr. ..... 439/578
3,460,072 A * 8/1969 Ziegler, Jr. ..... 439/585
3,533,051 A * 10/1970 Ziegler, Jr. ..... 439/585
3,870,978 A * 3/1975 Dreyer ..... 439/578
4,690,482 A * 9/1987 Chamberland et al. ..... 439/578
5,088,937 A * 2/1992 Gabany ..... 439/581
5,115,563 A * 5/1992 Wilson ..... 439/581
5,928,032 A * 7/1999 Dreesen ..... 439/578
5,971,770 A * 10/1999 Richmond ..... 439/63
6,164,977 A * 12/2000 Lester ..... 439/63
6,808,395 B2 * 10/2004 Lin et al. ..... 439/578

* cited by examiner

*Primary Examiner*—Briggitte R. Hammond
(74) *Attorney, Agent, or Firm*—Alan Kamrath; Kamrath & Associates PA

(57) ABSTRACT

An adapter for high frequency signal transmission includes in one embodiment a cylinder having a staged bore; a central transmission rod including an intermediate toothed ring, first and second ports at both ends, and a tapered portion formed around the first port. A first block is fitted in one portion of the bore. A second block is fitted in another portion of the bore and includes a metal ring having a toothed member secured onto the second block. A vacuum is created by the block, the second block, the toothed ring, and the bore. In alternate embodiments, both the first and second ports are male ports, both the first and second ports are female ports, the first port is a female port and the second port is a male port, or the first port is a male port and the second port is a female port.

11 Claims, 13 Drawing Sheets

ADAPTER FOR HIGH FREQUENCY SIGNAL TRANSMISSION

BACKGROUND OF THE INVENTION

1. Field of Invention

The present invention relates to adapters and, more particularly, to a connector shaped adapter for high frequency signal transmission with improved characteristics.

2. Related Art

A conventional adapter 10 for interconnecting, for example, a connector 70 of a testing instrument and a connector 70 of a device (e.g., mobile phone) to be tested is shown in FIGS. 1 and 2. Within the cylindrical adapter 10, there are provided a central transmission rod 20 and a plastic ring 30 formed between the transmission rod 20 and an inner surface of the adapter 10. The transmission rod 20 is, thus, fastened by the ring 30. However, its manufacturing process is time consuming and cost ineffective.

Another conventional adapter 40 of such type is shown in FIG. 3. Front and rear cylindrical sections 50 are formed of polytetrafluorethylene (PTFE), such as sold under the trademark TEFLON, and within an inner surface of the adapter 40. A central transmission rod 60 passes through the PTFE sections 50 and is, thus, fastened by the PTFE sections 50. However, the insulative PTFE sections 50 may absorb signals transmitted along the transmission rod 60, resulting in a decrease of the transmission efficiency. For increasing the transmission efficiency (e.g. wireless transmission), it is possible to increase power. However, a power increase may threaten health of nearby people due to electromagnetic radiation. Thus, a need for improvement exists.

SUMMARY OF THE INVENTION

It is therefore an object of the present invention to provide an adapter including a body including a first bore provided at one end, an intermediate second bore having a diameter larger than that of the first bore, and a third bore provided at the other end and having a diameter larger than that of the second bore. A first shoulder is provided between the first and the second bores, and a second shoulder is provided between the second and the third bores. A first PTFE block is adapted to be received in the second bore. A second PTFE block is adapted to be received in the third bore and includes a metal ring having a toothed member secured onto one portion of the second PTFE block. A central transmission rod includes an intermediate toothed ring provided on its outer surface, a first port provided at one end and inserted through said first PTFE block until said first PTFE block is against the toothed ring, a second port provided at the other end and inserted through said second PTFE block until a portion of the toothed ring is within the second PTFE block, and a tapered protrusion formed around the first port and protruding from the first PTFE block. The transmission rod is placed into the body so that there are air spaces around the tapered protrusion and between the first and second PTFE blocks. Thus, the contact area of the body and the first and second PTFE blocks is decreased, and air fills said spaces so as to create air insulation.

The above and other objects, features and advantages of the present invention will become apparent from the following detailed description taken with the accompanying drawings.

DETAILED DESCRIPTION OF THE INVENTION

Figure 1:
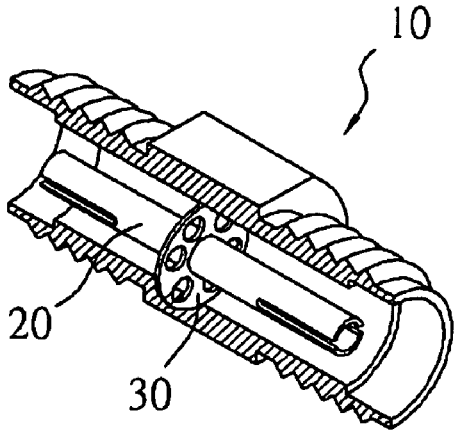
FIG. 1 Prior Art
FIG. 1 is a broken-away perspective view of a conventional adapter.
Figure 2:
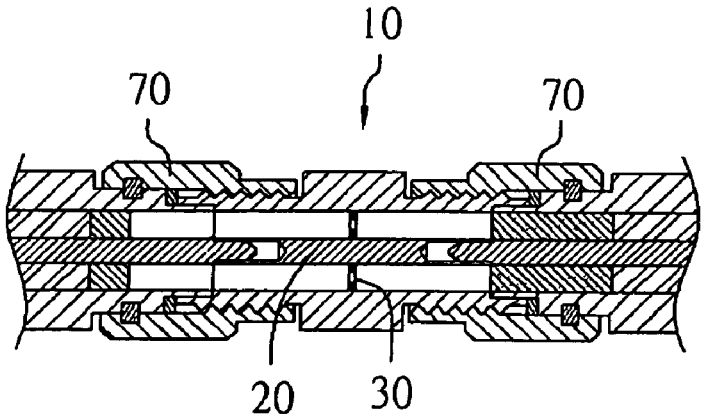
FIG. 2 Prior Art
FIG. 2 is a sectional view showing the adapter in FIG. 1 interconnecting two connectors.
Figure 3:
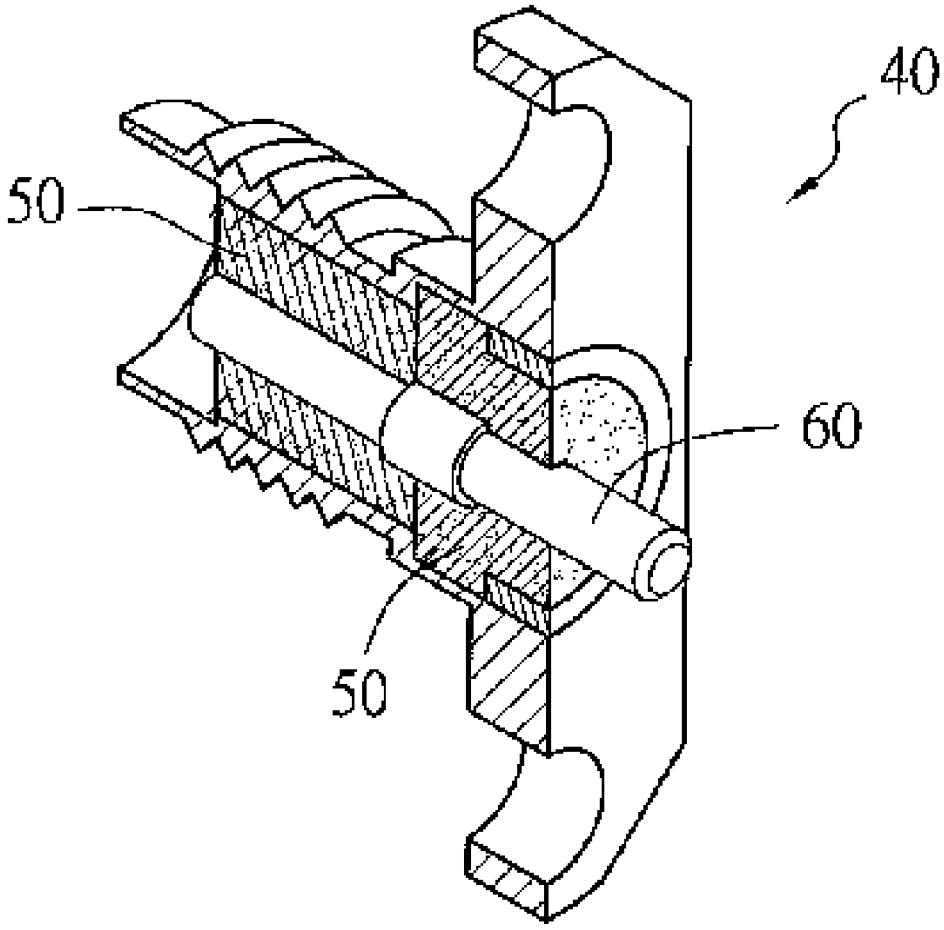
FIG. 3 Prior Art
FIG. 3 is a broken-away perspective view of another conventional adapter.
Figure 4:
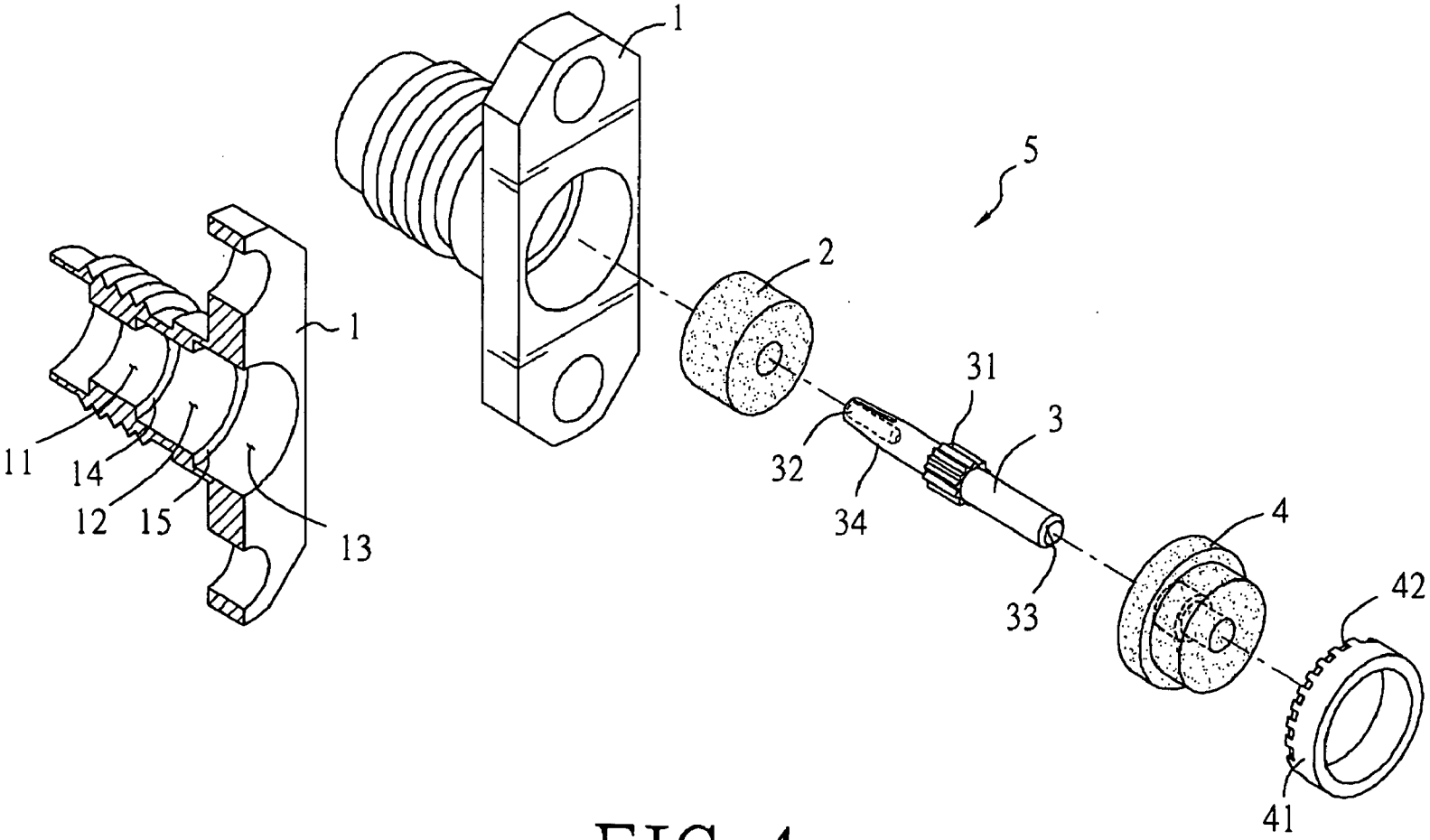
FIG. 4 is an exploded view of a first preferred embodiment of an adapter according to the invention.

Referring to FIGS. 4 to 11, an adapter 5 for high frequency signal transmission in accordance with a first preferred embodiment of the invention is illustrated. As shown in FIG. 4 specifically, the adapter 5 comprises a body 1 having a hollow cylinder, a first PTFE block 2, a central transmission rod 3, and a second PTFE block 4. Within the cylinder of the body 1, there are provided a first bore 11, a second bore 12 having a diameter larger than that of the first bore 11, and a third bore 13 having a diameter larger than that of the second bore 12. A first shoulder 14 is between the first and the second bores 11 and 12, and a second shoulder 15 is between the second and the third bores 12 and 13. The first PTFE block 2 is fitted within the second bore 12 and has a length shorter than that of the second bore 12.

The transmission rod 3 comprises an intermediate toothed ring 31 on its outer surface, a female port 32 at one end, and a male port 33 at the other end. Note that the transmission rod 3 may have two male ports 33 at both ends, two female ports 32 at both ends, or a female port 32 and a male port 33. The second PTFE block 4 is fitted within the third bore 13 and includes a metal ring 41 having a toothed section 42 on one edge adjacent the second PTFE block 4.

Figure 5:
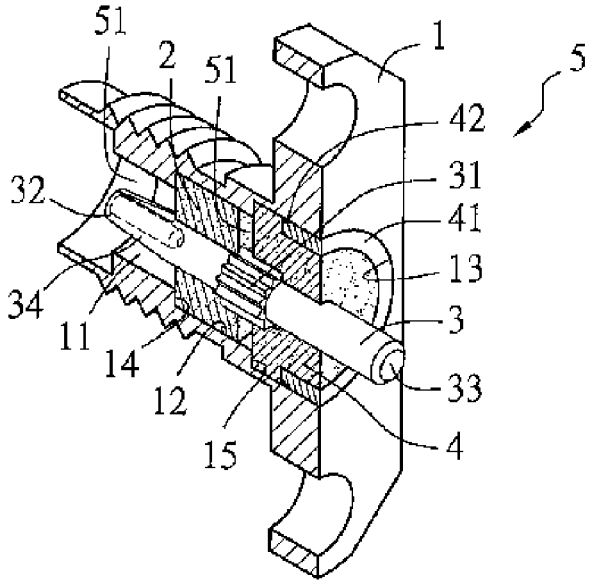
FIG. 5 is a broken-away perspective view of the adapter in FIG. 4.

As shown in FIG. 5 specifically, in assembly, the first PTFE block 2 is inserted into the second bore 12 from the female port 32 until the first PTFE block 2 is against the toothed ring 31. The protrusion of the transmission rod 3 from the first PTFE block 2 forms a tapered protrusion 34. The male portion 33 of the transmission rod 3 is inserted through the second PTFE block 4 until most portions of the toothed ring 31 are within the second PTFE block 4. Finally, the transmission rod 3 with the first and second PTFE blocks 2 and 4 is snugly inserted into the body 1 until the first PTFE block 2 is stopped by the first shoulder 14 and set within the second bore 12, the second PTFE block 4 is stopped by the second shoulder 15 and set within the third bore 13, and the tapered protrusion 34 is disposed in the first bore 11. The metal ring 41 is set into an annular gap between the second PTFE block 4 and an inner surface of the third bore 13, with the toothed member 42 secured onto the second PTFE block 4 enhancing friction so as to prevent the first and second PTFE blocks 2 and 4 and the transmission rod 3 from rotating in the body 1. Spaces 51 filled with air are respectively created in the first bore 11 and between the first and second PTFE blocks 2 and 4 to act as air insulation.

Figure 6:
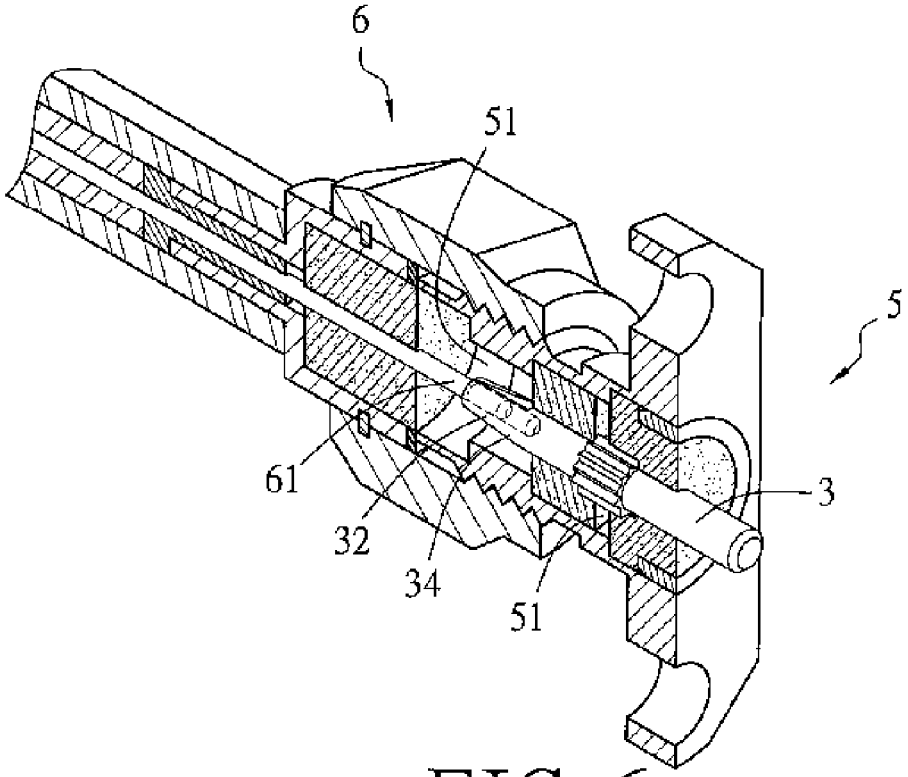
FIG. 6 is a broken-away perspective view of the adapter in FIG. 4 connected to a connector of a testing instrument.

As shown in FIG. 6 specifically, the adapter 5 is connected to a connector 6 of a testing instrument (not shown) in which one end of a central conductor 61 is inserted into the female port 32 for electrical connection. The space 51 is adapted to decrease a contact area of the transmission rod 3 and the body 1, resulting in an increase of the transmission efficiency.

Figure 8:
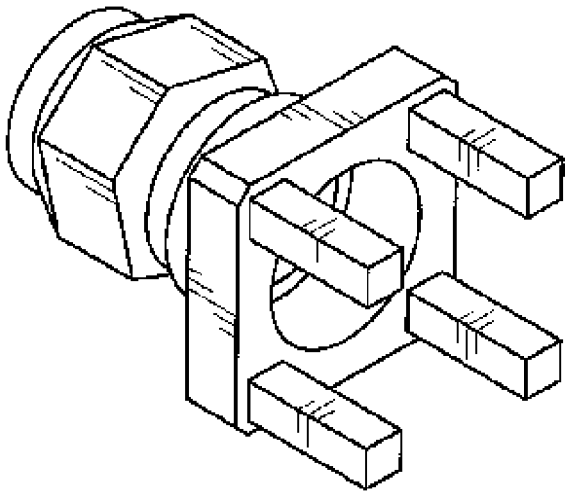
FIG. 8 is a perspective view of the adapter in FIG. 4 having its appearance altered to resemble a connector for a computer's motherboard.
Figure 9:
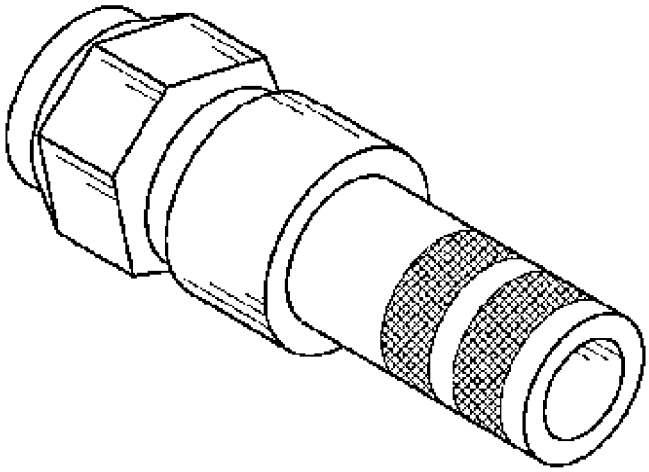
FIG. 9 is a view similar to FIG. 8 with the adapter having its appearance altered to resemble a transverse connector.
Figure 10:
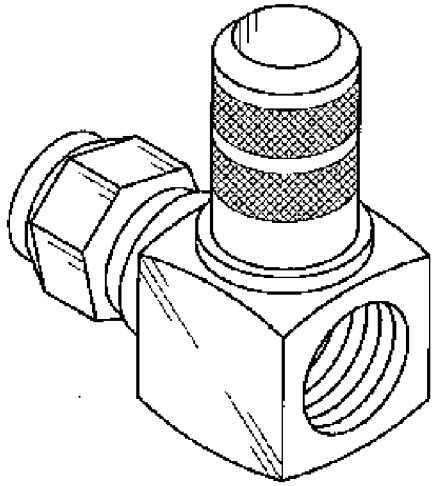
FIG. 10 is a view similar to FIG. 8 with the adapter having its appearance altered to resemble an L-shaped connector.
Figure 11:
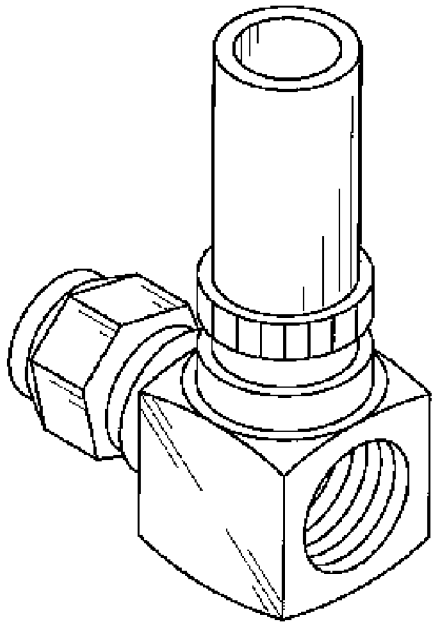
FIG. 11 is a view similar to FIG. 8 with the adapter having its appearance altered to resemble an upright connector.

As shown in FIG. 8 specifically, the adapter according to the first preferred embodiment of the invention is modified to resemble a connector for a computer's motherboard. As shown in FIG. 9 specifically, the adapter is again modified to resemble a connector of a coaxial cable. As shown in FIG. 10 specifically, the adapter is again modified to resemble an L-shaped coaxial connector. As shown in FIG. 11 specifically, the adapter is again modified to resemble an antenna connector.

Figure 7:
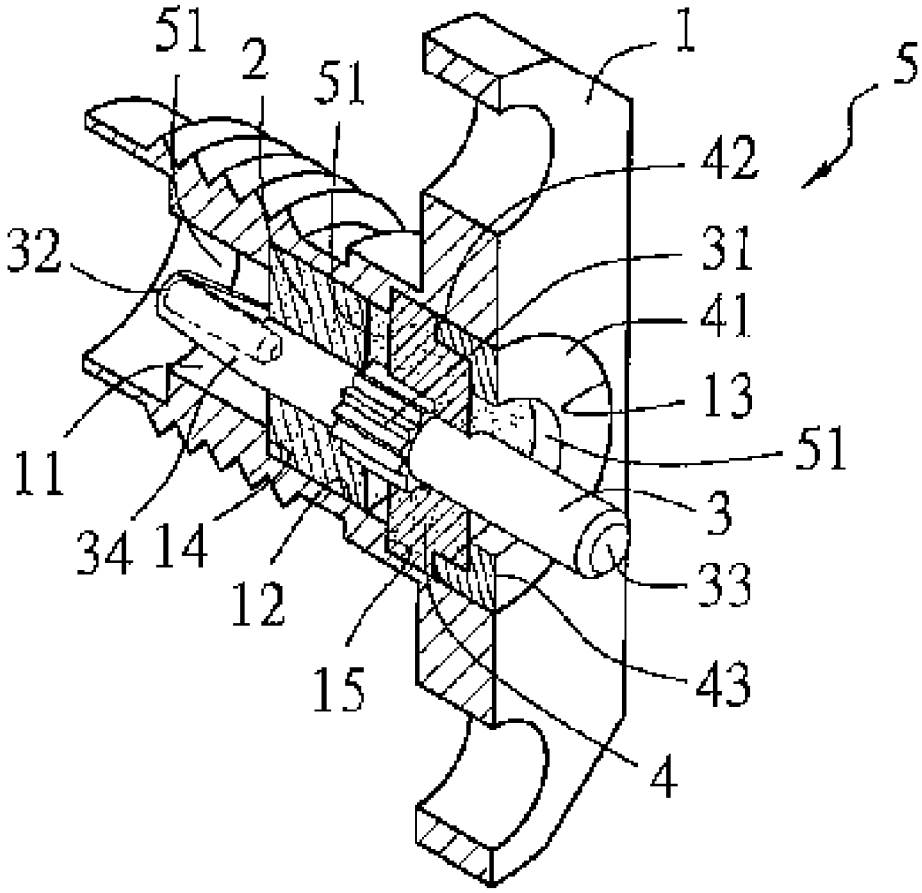
FIG. 7 is a view similar to FIG. 5 with the second PTFE block and the metal ring both slightly altered in another configuration.

As shown in FIG. 7 specifically, both of the second PTFE block 4 and the metal ring 41 are slightly altered in another configuration in which the second PTFE block 4 has its thickness reduced to about half. The metal ring 41 has an inwardly extended rim 43 engaged with the second PTFE block 4 so as to prevent the second PTFE block 4 from becoming loose and so as to create another space 51 filled with air to act as air insulation.

Figure 12:
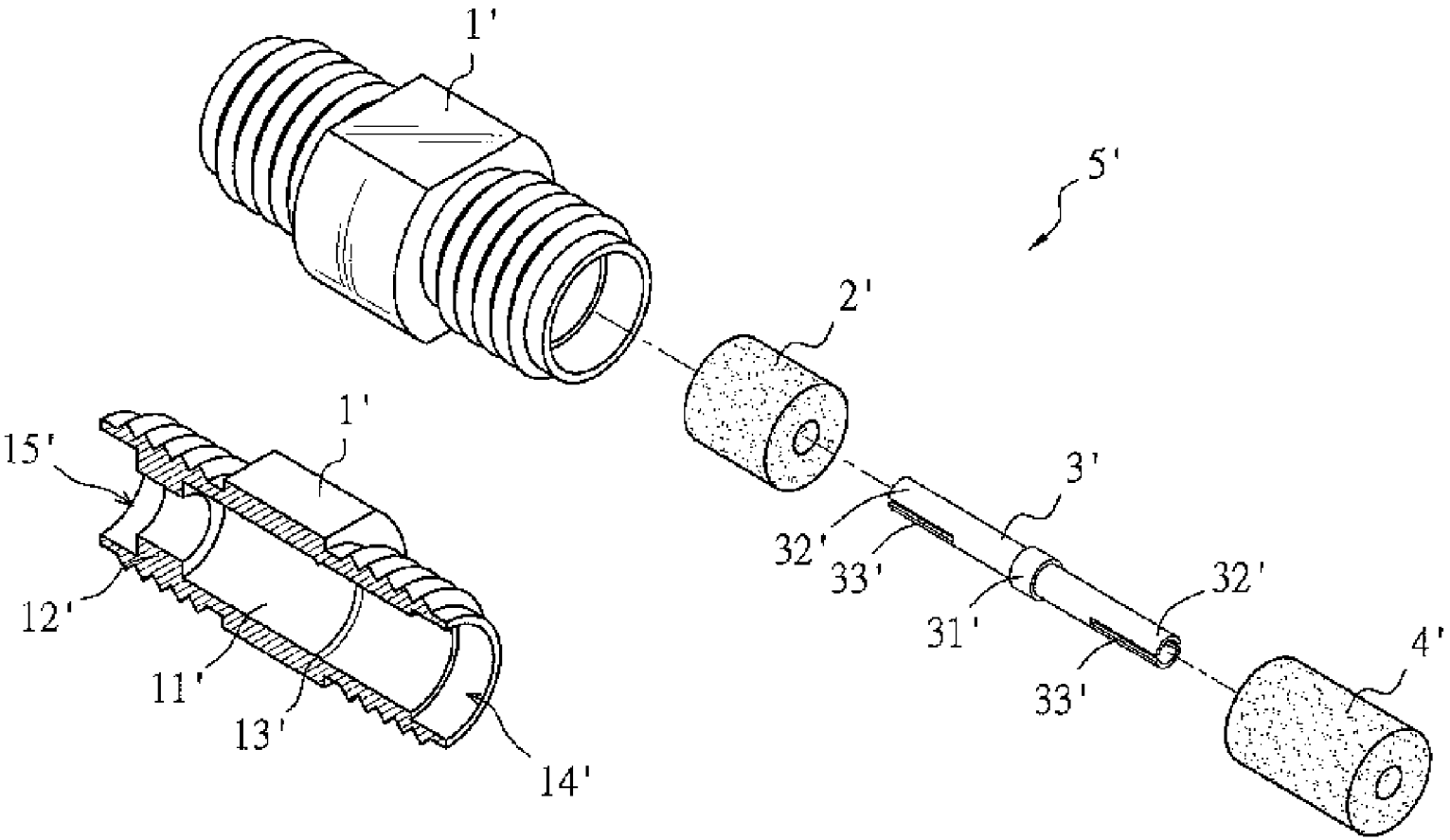
FIG. 12 is an exploded view of a second preferred embodiment of an adapter according to the invention.
Figure 13:
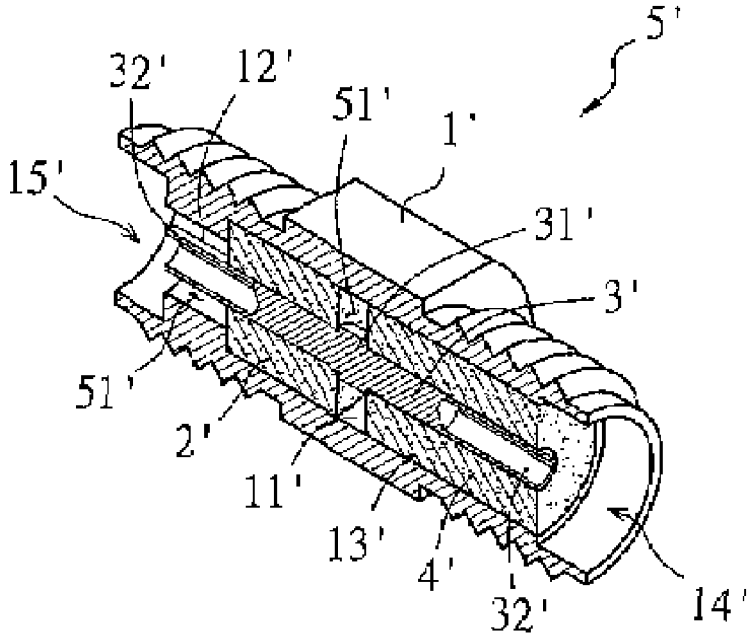
FIG. 13 is a broken-away perspective view of the adapter in FIG. 12.

Referring to FIGS. 12 to 18, an adapter 5' for high frequency signal transmission in accordance with a second preferred embodiment of the invention is illustrated. As shown in FIGS. 12 and 13 specifically, the adapter 5' comprises a hollow cylindrical body 1' having an intermediate enlargement. Within the body 1', there are provided a room 11', a reduced section 12' at one side of the room 11' and an annular flange 13' at a predetermined section of the room 11'. The adapter 5' further comprises a first PTFE block 2', a central transmission rod 3', and a second PTFE block 4'.

The transmission rod 3' comprises an intermediate ring 31'. Each end of the transmission rod 3' is formed into a female port 32'. Two opposite slits 33' are provided at each of the two female ports 32'. Note that the transmission rod 3' may have two male ports 33 at both ends, or a female port 32' at the one end and a male port 33 at the other end in other embodiments.

The transmission rod 3' has a front half inserted through the first PTFE block 2' and a rear half inserted through the second PTFE block 4' until the first and second PTFE blocks 2' and 4' are, respectively, against the ring 31' so that the first PTFE block 2' and the second PTFE block 4' are spaced by the ring 31'. The transmission rod 3' is then inserted into the body 1' until the first PTFE block 2' is against the reduced section 12'. The second PTFE block 4' is stuck because of the flange 13'. Thus, a space 51' filled with air acting as air insulation is created in a space defined by the ring 31', the first PTFE block 2', the second PTFE block 4', and an inner wall of the room 11'. Thus, one of the female ports 32' is level with the second PTFE block 4' to form a PTFE terminal 14', and the other of the female port 32' protrudes from the first PTFE block 2' to the reduced section 12' and forms another space 51' filled with air acting as air insulation, so as to form an air terminal 15'. Therefore, the adapter 5' has two different types of insulative ends.

Figure 14:
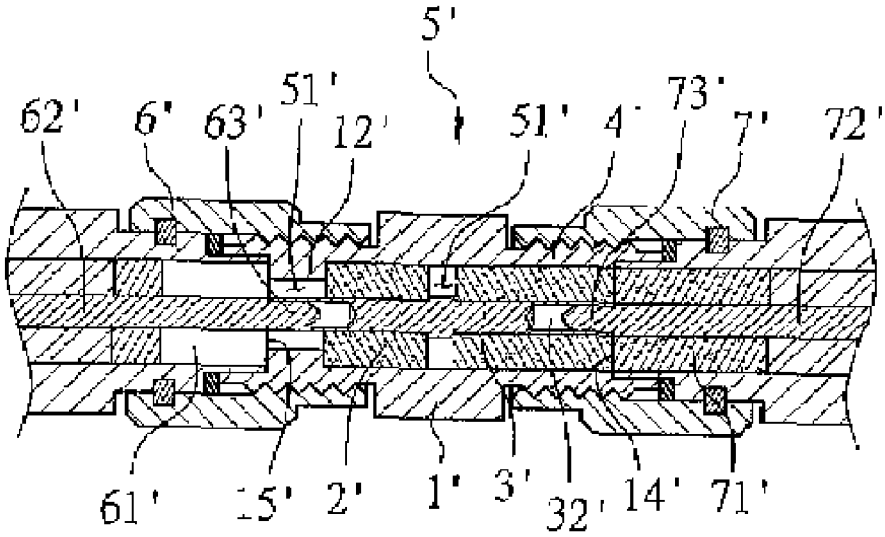
FIGS. 14 and 15 are sectional views showing a first configuration of the adapter in FIG. 12.

As shown in FIG. 14 specifically, a connector 6' of a testing instrument is a terminal 61' filled with air (i.e., air terminal 61') and a connector 7' of a device to be tested includes a PTFE terminal 71'. The PTFE terminal 14' of the adapter 5' is connected to the PTFE terminal 71' of the connector 7' of the device to be tested. A male port 73' of a transmission rod 72' of the device to be tested is inserted into one of the female ports 32' of the transmission rod 3' of the adapter 5'. The air terminal 15' of the adapter 5' is connected to the air terminal 61' of the connector 6' of the testing instrument. The male port 63' of the transmission rod 62' is inserted into the other of female ports 32' of the transmission rod 3' of the adapter 5'. Both ends of the adapter 5' are connected to the insulative members. As an end, test data is more accurate, and its result is, thus, more reliable.

Figure 15:
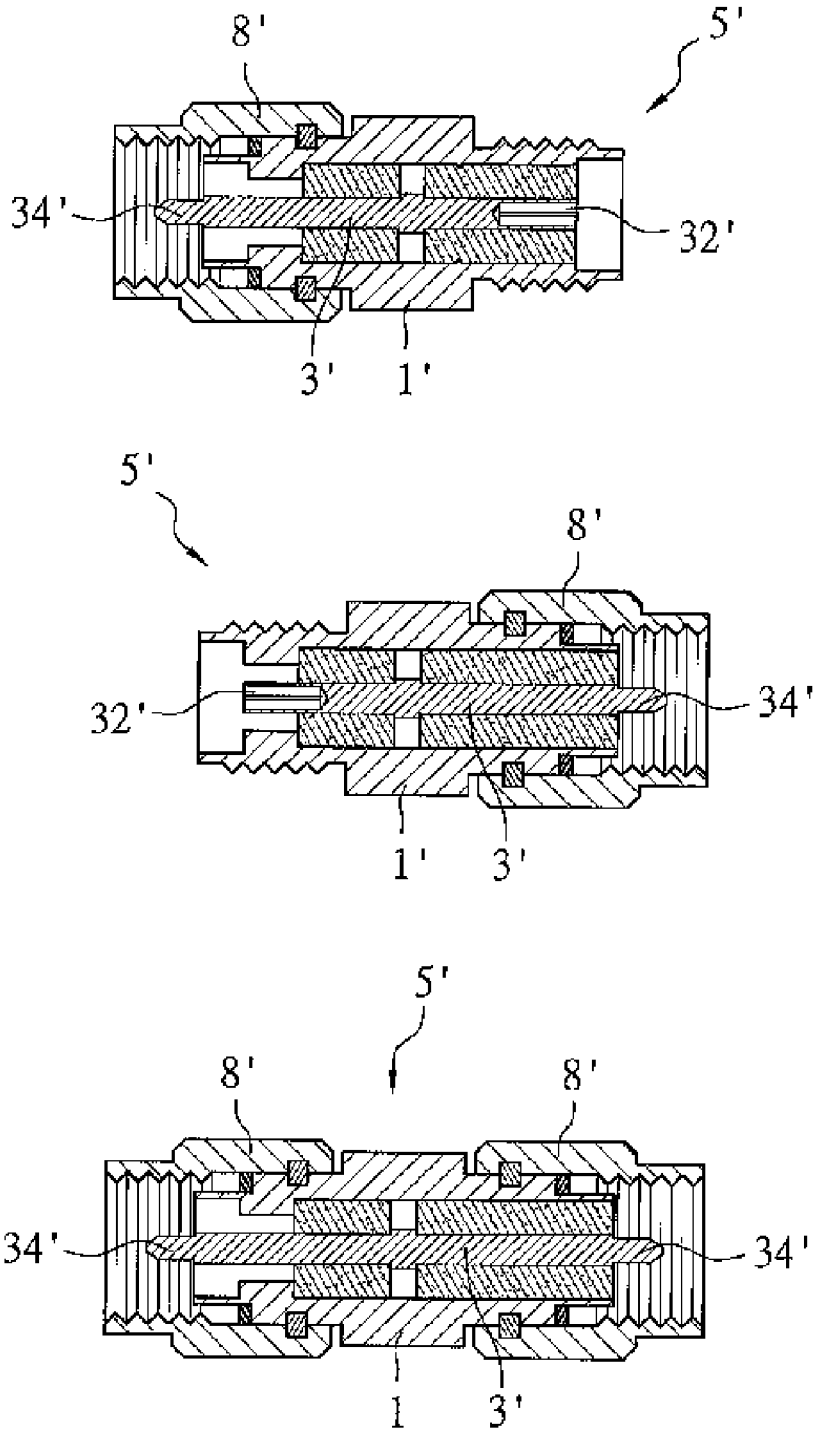

As shown in FIGS. 13–15 specifically, a first configuration of the adapter 5' is shown. Two ends of the transmission rod 3' of the adapter 5' may be modified to have two male ports 34', two female ports 32', or a male port 34' at the one end and a female port 32' at the other end. Also, a connector 8' is connected to male port 34' of the adapter 5'. As a result, it is possible of configuring both ends of the adapter 5' to have different insulative members.

Figure 16:
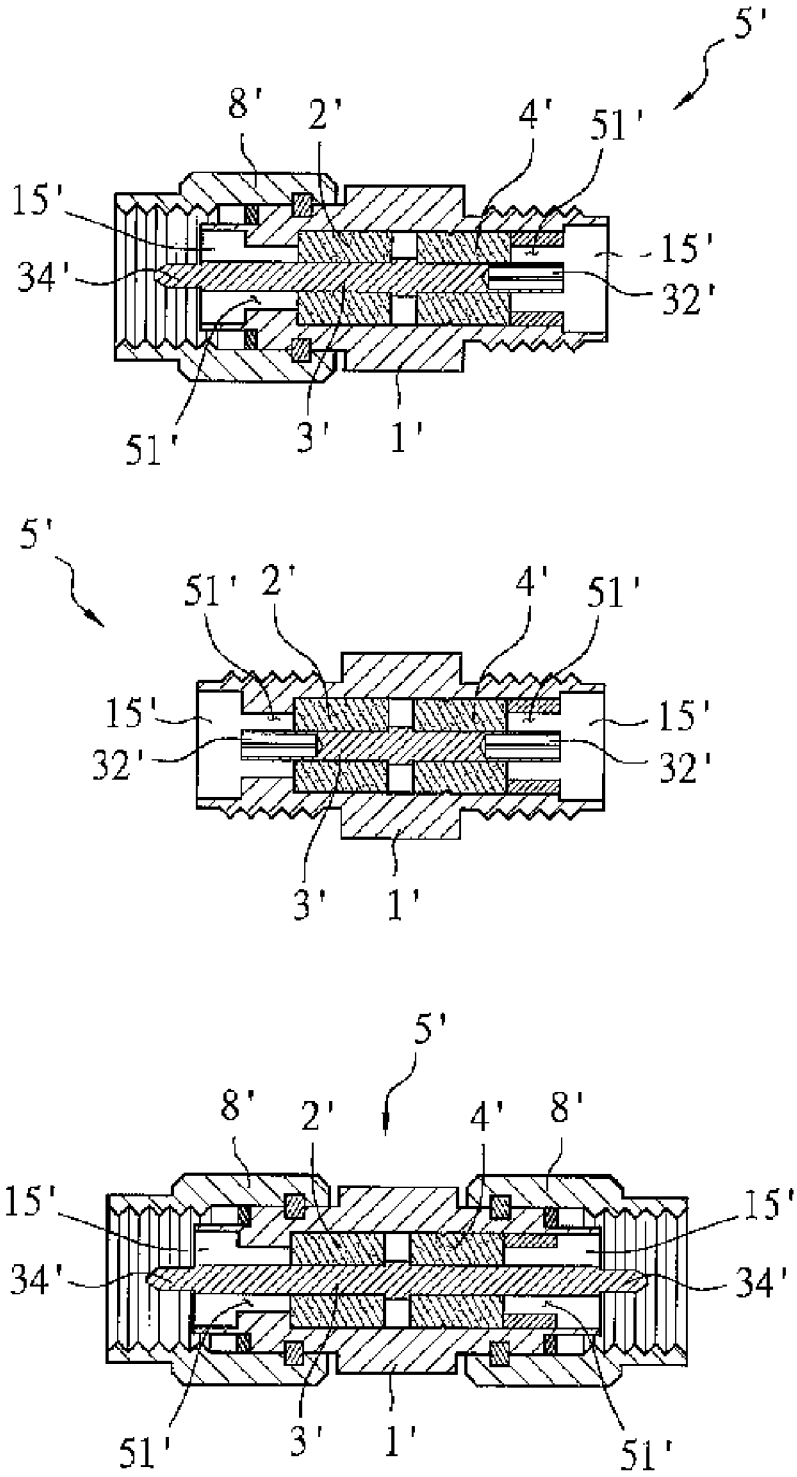
FIG. 16 is a sectional view showing a second configuration of the adapter in FIG. 12.

FIG. 16 shows a second configuration of the adapter 5'. Changing the thickness of the second PTFE block 4' will configure both ends of the adapter 5' as air terminals 15'. Both ends of the transmission rod 3' of the adapter 5' will form spaces 51' filled with air to act as air insulation. Further, both ends of the transmission rod 3' of the adapter 5' may be implemented as two male ports 34', two female ports 32', or a male port 34' at the one end and a female port 32' at the other end.

Figure 17:
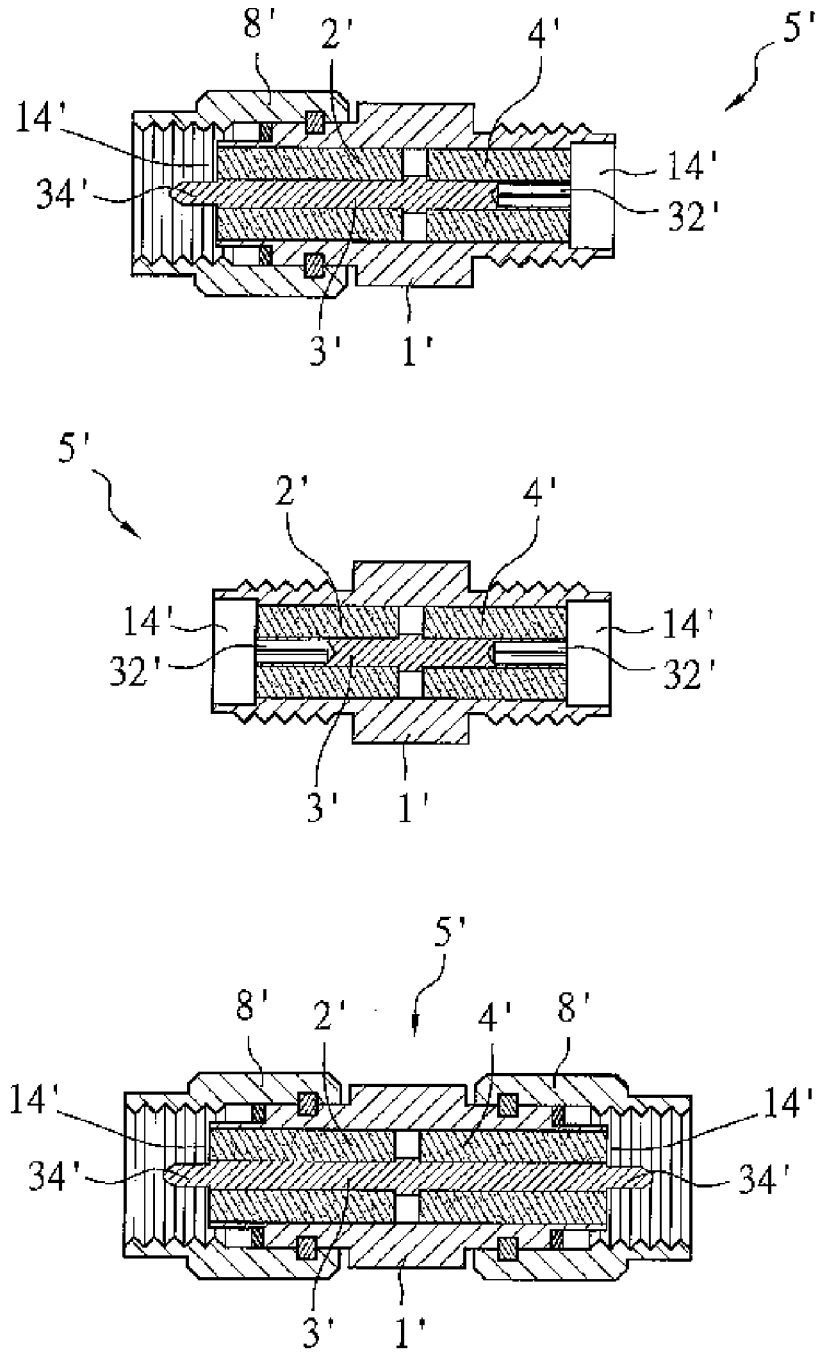
FIG. 17 is a sectional view showing a third configuration of the adapter in FIG. 12.

FIG. 17 shows a third configuration of the adapter 5'. Eliminating the reduced section 12' and the flange 13', and fitting the first PTFE block 2' and the second PTFE block 4' in the body 1' will configure both ends of the adapter 5' as PTFE terminals 14'. Also, the ends of the transmission rod 3' of the adapter 5' may be implemented as two male ports 34', two female ports 32', or a male port 34' at the one end and a female port 32' at the other end.

Figure 18:
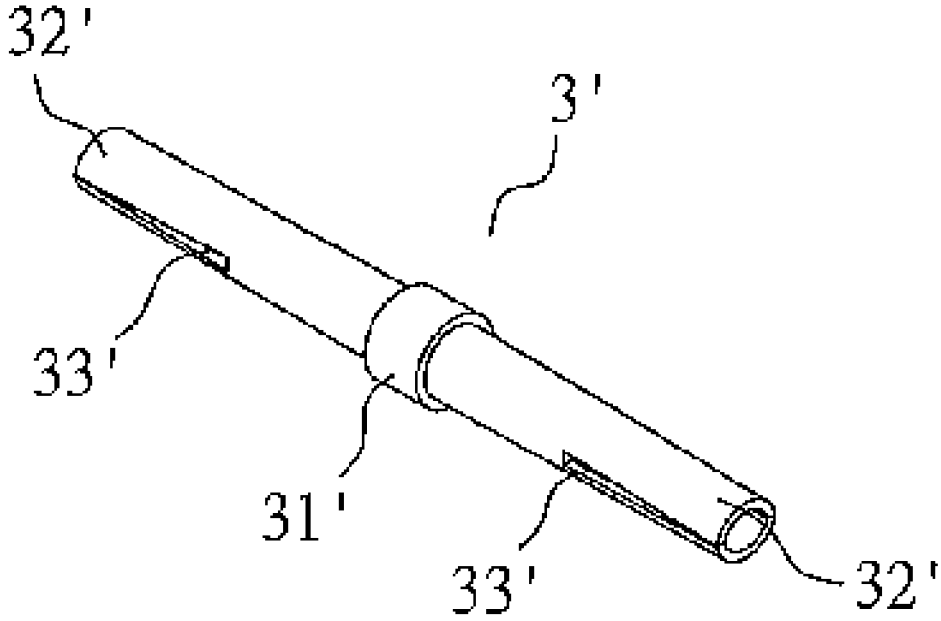
FIG. 18 is a perspective view of a transmission rod according to the preferred embodiment of the present invention.

As shown in FIG. 18 specifically, a pair of slits 33 are provided at either female port 32' of the transmission rod 3' to facilitate the pressing of the female ports 32'. By pressing the female ports 32' to be tapered ends, the fastening is more reliable.

While the invention herein disclosed has been described by means of specific embodiments, numerous modifications and variations could be made thereto by those skilled in the art without departing from the scope and spirit of the invention set forth in the claims.

What is claimed is:

1. An adapter comprising:

a body including a first bore provided at one end, an intermediate second bore having a diameter larger than that of the first bore, a third bore provided at the other end and having a diameter larger than that of the second bore, a first shoulder provided between the first and the second bores, and a second shoulder provided between the second and the third bores;

a first polytetrafluorethylene block adapted to be received in the intermediate second bore;

a second polytetrafluoroethylene block adapted to be received in the third bore and including a metal ring secured onto one portion of the second polytetrafluoroethylene block;

a central transmission rod including an intermediate toothed ring provided on its outer surface, a first port provided at one end and inserted through said first polytetrafluoroethylene block until said first polytetrafluoroethylene block is against the toothed ring, a second port provided at the other end and inserted through said second polytetrafluoroethylene block until a portion of the toothed ring is within the second polytetrafluoroethylene block, and a tapered protrusion formed around the first port and protruding from the first polytetrafluoroethylene block, with said transmission rod being placed into the body so that there are spaces around the tapered protrusion and between the first and second polytetrafluoroethylene blocks;

whereby the contact area of the body and the first and second polytetrafluoroethylene blocks is decreased and air fills said spaces so as to create air insulation.

2. The adapter of claim 1, wherein the thickness of the second polytetrafluoroethylene block is reduced and the metal ring further includes an inwardly extended rim engaged with the second polytetrafluoroethylene block so as to create another space for increased air insulation.

3. The adapter of claim 1, wherein the metal ring of the second polytetrafluoroethylene block is provided with a toothed member for enhancing friction so as to prevent rotation.

4. The adapter of claim 1, wherein the adapter is a connector for a computer's motherboard, a transverse connector, an L-shaped connector or upright connector.

5. The adapter of claim 1, wherein the transmission rod has a length and the spaces have a total length of about 20–80% of the length of the transmission rod.

6. The adapter of claim 1, wherein the first port is one of a male port and a female port.

7. The adapter of claim 1, wherein the second port is one of a male port and a female port.

8. An adapter comprising:

a hollow body including an intermediate enlargement, a room provided at a first end, a reduced section proximate the room, a terminal space provided at a second end, and an annular flange provided at a predetermined section of the room, with the reduced section located intermediate the terminal space and the room and having cross sections smaller than the room and the terminal space;

a first polytetrafluoroethylene block;

a second polytetrafluoroethylene block; and a central transmission rod inserted through both the first and the second polytetrafluoroethylene blocks and including an integral intermediate ring of an increased cross sectional size a first port provided at one end, and a second port provided at the other end;

said central transmission rod being inserted into the body until said first polytetrafluoroethylene block is against the reduced section and the intermediate ring, with the second polytetrafluoroethylene block abutting with the intermediate ring and fastened by the flange, with the second port being level with the second polytetrafluoroethylene block with the first port protruding from the first polytetrafluoroethylene block and through the reduced section and forming an empty space filled with air, with the first and second polytetrafluoroethylene blocks separated by the intermediate ring forming an empty space defined between the first and second polytetrafluoroethylene blocks and between the intermediate ring and the room and filled with air.

9. The adapter of claim 8, wherein both the first and second ports are female ports and having a pair of slits respectively to facilitate pressing of the female ports to be tapered ends.

10. The adapter of claim 8, wherein the first port is one of a male port and a female port.

11. The adapter of claim 8, wherein the second port is one of a male port and a female port.

* * * * *